US008267059B2

(12) United States Patent
Manther et al.

(10) Patent No.: US 8,267,059 B2
(45) Date of Patent: Sep. 18, 2012

(54) SWITCHABLE FINGER LEVER

(75) Inventors: Debora Manther, Royal Oak, MI (US); Jeffrey Shewell, Clawson, MI (US); Jeff Villemure, Eastpointe, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 316 days.

(21) Appl. No.: 12/800,151

(22) Filed: May 10, 2010

(65) Prior Publication Data

US 2010/0300389 A1 Dec. 2, 2010

Related U.S. Application Data

(60) Provisional application No. 61/217,540, filed on Jun. 1, 2009.

(51) Int. Cl.
*F01L 1/18* (2006.01)

(52) U.S. Cl. ..... 123/90.39; 123/90.16; 123/90.44; 29/888.2; 74/559; 74/569

(58) Field of Classification Search ..... 123/90.16, 123/90.39, 90.44; 29/888.2; 74/559, 569, 74/567

See application file for complete search history.

(56) References Cited

U.S. PATENT DOCUMENTS 7,328,675 B2 * 2/2008 Seitz et al. ..... 123/90.39

* cited by examiner

*Primary Examiner* — Ching Chang
(74) *Attorney, Agent, or Firm* — Volpe and Koenig, P.C.

(57) ABSTRACT

The invention proposes a switchable finger lever (1) comprising an inner lever (2) comprising on one end (4), a support (5) for a gas exchange valve and on another end (6), a contact surface (7) for a head of a support element, said inner lever (2) comprising on the one end (4), pivotable outer arms (8) made separately from each other, which outer arms (8) comprise on their upper sides (10), contacting surfaces (11) for high lift cams, a coupling device (12) comprising a coupling slide (13) for simultaneously connecting the outer arms (8) to the inner lever (2) being seated in a section of the another end (6) in the inner lever (2), which coupling slide (13) is seated in an oblong hole (14) extending transversely through the inner lever (2) as also in longitudinal direction of the finger lever (2), the coupling slide (13) comprises two end portions (15) which protrude beyond the outer walls (9),and for effecting coupling, the coupling slide (13) can be displaced with the two end portions (15) partially under entraining surfaces (16) of the outer arms (8), whereas for effecting uncoupling, the coupling slide (13) can be displaced out of the entraining surfaces (16), and at least one restoring spring (17) extends in the region of the another end (6) between the inner lever (2) and the outer arms (8).

16 Claims, 2 Drawing Sheets

SWITCHABLE FINGER LEVER

The present application claims the benefit of U.S. provisional application Ser. No. 61/217,540 filed Jun. 1, 2009.

FIELD OF THE INVENTION

The invention concerns a switchable finger lever for a valve train of an internal combustion engine, said finger lever comprising an inner lever comprising on an underside on one end, a support for a gas exchange valve and on another end, a contact surface for a head of a support element, said inner lever comprising on the one end, outer arms which are pivotable relative to the inner lever, which outer arms extend in direction of the another end while flanking outer walls of the inner lever and comprise on upper sides, contacting surfaces for high lift cams, a coupling device comprising a coupling slide for connecting the outer arms to the inner lever being seated in the inner lever, and a restoring spring being clamped between the inner lever and the outer arms.

BACKGROUND OF THE INVENTION

Known prior art switchable finger levers (s. DE 103 10 968 A1) have a too solid construction and are too large in longitudinal and in transverse direction, they also have a too complicated structure for mass production, are too complex to assemble and, due to the arrangement of important components such as the restoring spring means on their valve side, they possess an excessively high mass moment of inertia.

Besides this, the prior art finger lever of the aforesaid document has a coupling mechanism with a too complicated design necessitating relatively high actuation forces. Because of the lateral outward displacement of the coupling slides which act independently of each other, there exists the danger, at least in case of uncoupling, that during the given base circle interval, only one of the coupling slides is adequately retracted, so that an unnecessary wear or a destruction of components is likely to occur.

OBJECT OF THE INVENTION

It is therefore an object of the invention to provide a switchable finger lever of the pre-cited type in which the aforesaid drawbacks are eliminated. In particular, the invention aims at providing a light-weight finger lever with a low mass moment of inertia as a compact structure possessing a reliable and simple-functioning coupling mechanism.

SUMMARY OF THE INVENTION

The invention achieves the above object by the fact that the coupling device is seated in a section of the another end in the inner lever and is configured so that the coupling slide forcedly connects the separate outer arms simultaneously to each other, which coupling slide is seated in an oblong hole extending transversely through the inner lever as also in longitudinal direction of the finger lever, the coupling slide comprises two end portions which protrude beyond the outer walls, and for effecting coupling [high valve lift], the coupling slide can be displaced with the two end portions towards the one end partially in or under entraining surfaces of the outer arms ending in this region, whereas for effecting uncoupling, the coupling slide can be displaced out of the entraining surfaces towards the another end, and wherein the at least one restoring spring likewise extends in the region of the another end between the inner lever and the outer arms.

In this way, a switchable finger lever with a small mass and a compact structure is provided which, due to the arrangement of important elements such as the coupling device and the restoring spring on the another end, possesses only a relatively low mass moment of inertia. Due to the forced coupling of the two outer arms through the coupling slide which is displaceable longitudinally in the oblong hole, a reliable coupling and uncoupling, free of switching errors, is achieved.

According to a particularly preferred feature of the invention, the outer arms are configured as separate pieces from each other. Among other things, this measure helps save mass. It is, however, also conceivable and intended to connect the outer arms, for instance on the one end, through a bow-shaped clip.

The switchable finger lever can be configured either as a lift alteration switch or as a lift deactivator, its individual parts are easy to assemble and it is well-suited for mass production.

Particularly suitable as a contact surface for the support element on the underside of the inner lever is a semi-spherical cavity. However, the invention also includes provision of an articulated joint in this region.

A particular contribution to obtaining a light-weight structure is made by the fact that the outer arms extend with their front ends only exactly up to the laterally protruding coupling slide. Particularly well-suited as entraining surfaces on the outer arms are flats or semi-spherical cavities on their undersides, the use of bores or similar openings, however, also being conceivable.

Preferably, engaging regions of the end portions of the coupling slides with the entraining surfaces of the outer arms are cylindrical in shape. However, they can also have a shape different from this. For example, these engaging regions can be flat.

Preferably, two restoring springs (lost motion springs) are arranged on the another end of the inner lever. According to one proposition of the invention, these springs are torsion leg springs whose coil regions are seated on axle stubs protruding sideward from the inner lever. An inner, first leg of the torsion leg springs comes to bear against a stop of the inner lever. An outer, second leg of the torsion leg springs cooperates with a support on an underside of the outer arms.

According to a particularly preferred feature of the invention, flanks of the second legs in mesh with the support of the respective outer arm correspond at least partially to an involute toothing of gearwheel teeth in mesh with each other.

According to one advantageous development of the invention, the inner lever comprises in a region above the contact surface, a longitudinal bore including an entraining piston which can be hydraulically displaced in at least one direction. For a return displacement in opposition to hydraulic medium pressure, the invention proposes to use the force of a compression spring. According to another feature of the invention, the entraining piston comprises a crosswise extending incision in which the entraining piston is centrally seated. In this way, the coupling slide is indirectly actuated by the entraining piston. Advantageously, the coupling slide should be guided only by the side walls of the incision of the entraining piston.

According to a further development of the invention, the longitudinal bore for the entraining piston starts from a front end surface of the inner lever on the another end. Advantageously, starting from the aforesaid front end surface, this bore is bored in direction of the one end and can be configured as a pocket bore, a through-bore or a stepped bore.

Closure of the longitudinal bore on the another end is proposed through a separate plug. This can have, for instance, a disk-like geometry and be secured through a snap ring or the like. However, it is also conceivable and intended to use a screw closure or the like for closing the bore.

To avoid a compression of air in the longitudinal bore, at least one ventilating aperture, such as a bore, leads out of the longitudinal bore (spring side). To save design space, the compression spring for the return displacement of the entraining piston can be situated in a recess of another front end of the entraining piston.

Advantageously, the oblong hole for guiding the coupling slide extends axially only so far that the coupling slide, in its maximally extended position, does not render free the oblong hole so that no hydraulic medium loss can take place.

The invention further proposes a measure for a simple axial fixing of the coupling slide through an arrangement of snap rings on both ends of the coupling slide, which snap rings bear directly against the outer walls of the inner lever. For this purpose, the invention proposes the use of snap rings with frictional locking or "classical" ondular snap rings or bent ondular snap rings, the latter then extending in annular grooves on the outer periphery of the coupling slide.

If the finger lever is configured as a lift alteration switch, the finger lever comprises in its central region two spaced apart arms which receive a rotatable roller for serving as a running surface for a low lift cam. The invention also includes using a sliding surface in place of the roller.

According to a further feature of the invention, the contacting surfaces of the outer arms are configured as cylindrical (slightly) arched sliding surfaces which protrude outwards after the manner of wings from the outer arms. It is clear in this connection that at least the outer arms made out of sheet steel can be manufactured substantially by a punching and bending method. Alternatively to the sliding surfaces which, if necessary, can comprise wear resistant coatings, it is also possible to use rotatable rollers.

According to an advantageous proposition of the invention, two axle stubs protruding sideward can be arranged on the one end of the inner lever to enable a pivotal mounting of the outer arms. It is clear to a person skilled in the art that, for this purpose, it is also possible to use a continuous axle or axle stubs projecting from inner sides of he outer arms and extending into corresponding receptions in the inner lever. In the case of the first-mentioned axle stubs, a simple axial fixing of the outer arms can be achieved, for instance, through (bent) snap rings etc.

The invention further proposes a method of assembling the coupling device as well as for adjusting a coupling lash. It is clear that, in addition to the proposed method steps, further steps—preliminary, intermediate or subsequent—may also be used.

A simple measure for adjusting the coupling lash constitutes a substantial feature of the method of the invention. Put in highly simplified terms, after insertion of a calibrating coupling slide, an idle displacement of the outer arms till they reach their coupled position is measured on the calibrating coupling slide, following which, according to a calculation procedure known to the person skilled in the art, an appropriate, variable thickness, off-the-shelf coupling slide is installed such that an at least approximately identical, feeble coupling lash is enabled for a wide number of similar finger levers.

BRIEF DESCRIPTION OF THE DRAWING

The invention is described below with reference to the appended drawing.

DETAILED DESCRIPTION OF THE DRAWING

Figure 1:
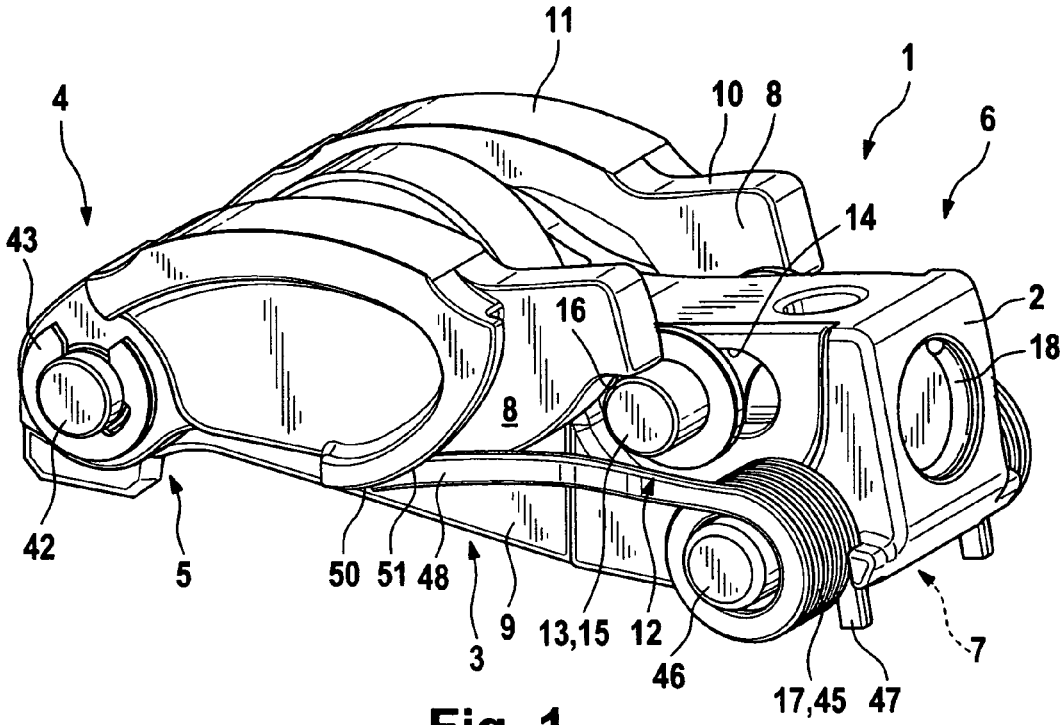
FIG. 1 shows a three-dimensional view of a finger lever of the invention seen from the another end.

The figures disclose a switchable finger lever 1 configured in the present case as a lift alteration switch. The finger lever 1 comprises an elongate inner lever 2 which comprises on an underside 3 at one end 4, a support 5 for an associated gas exchange valve. At another end 6, the inner lever 2 comprises on the underside 3 a contact surface 7 configured as a semi-spherical cavity for a pivotal mounting of a head of a support element, not illustrated.

Two axle stubs 42 protrude from the outer walls 9 of the inner lever 2 in the region of the one end 4. On each axle stub 42 is seated one outer arm 8. The outer arms 8 are fixed on the axle stubs 42 through appropriate anti-loss devices 43 such as bent snap rings.

As can be seen, the outer arms 8 do not extend over an entire length of the inner lever 2 but end with their front ends 44 in front of a coupling device 12 to be described later. Upper sides 10 of the outer arms 8 are slightly cylindrically arched and form contacting surfaces 11 for high lift cams. These contacting surfaces 11 extend outwards after the manner of a roof.

Figure 2:
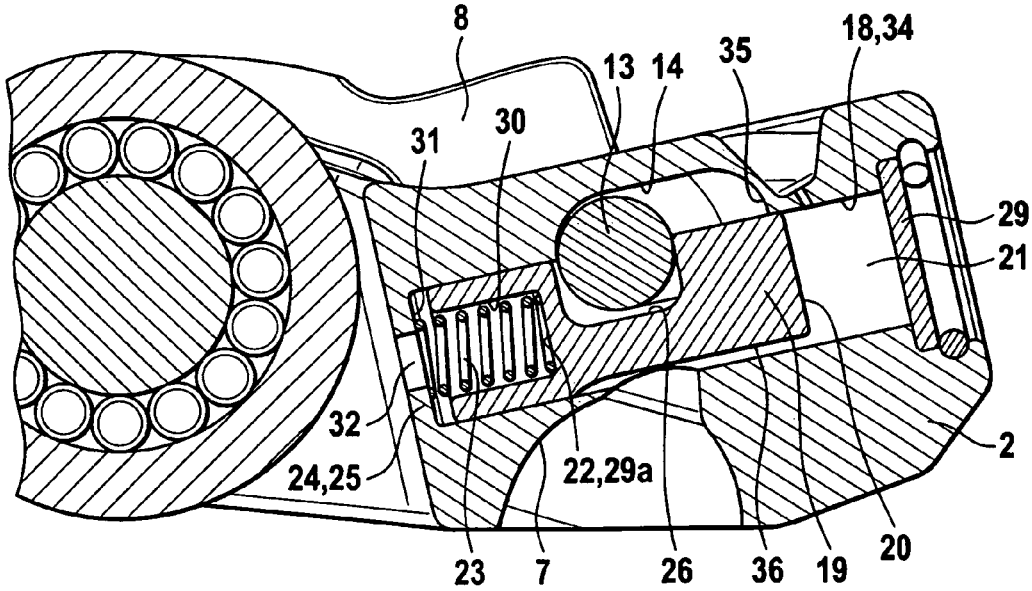
FIG. 2 shows a longitudinal section through the finger lever in the region of its coupling device.

In the region of the front ends 44, each outer arm 8 comprises an entraining surface 16 for a coupling slide 13 of the coupling device 12. FIGS. 1, 2 disclose a coupled state of the coupling device 12, so that a lift of the high lift cams in contact with the outer arms 8 is transmitted to the gas exchange valve.

The coupling device 12 comprises a longitudinal bore 18 starting from a front end surface 28 on the another end 6 of the inner lever 2, an entraining piston 19 being received for longitudinal displacement in said longitudinal bore 18. The entraining piston 19 defines, with its one front end 20 situated on the side of the another end 6, a pressure chamber 21 for hydraulic medium. Axially outwards, the pressure chamber 21 is closed by a plug 29. A supply of hydraulic medium into the pressure chamber 21 for realizing a coupled position of the coupling device 12 is effected through a longitudinal channel 36 on an underside of the entraining piston 19.

A displacement of the entraining piston 19 into an uncoupled position, i.e. in direction of the another end 6 is realized through the force of a compression spring 23 (alternatively also through hydraulic medium). The compression spring 23 is supported with its one end on a bottom 29*a* of another front end 22 of the entraining piston 19. Another end of the compression spring 23 acts against a bottom 31 of the longitudinal bore 18. In this region is also provided a ventilating aperture 32, so that no undesired compression of air takes place upon a corresponding displacement of the entraining piston 19.

Figure 3:
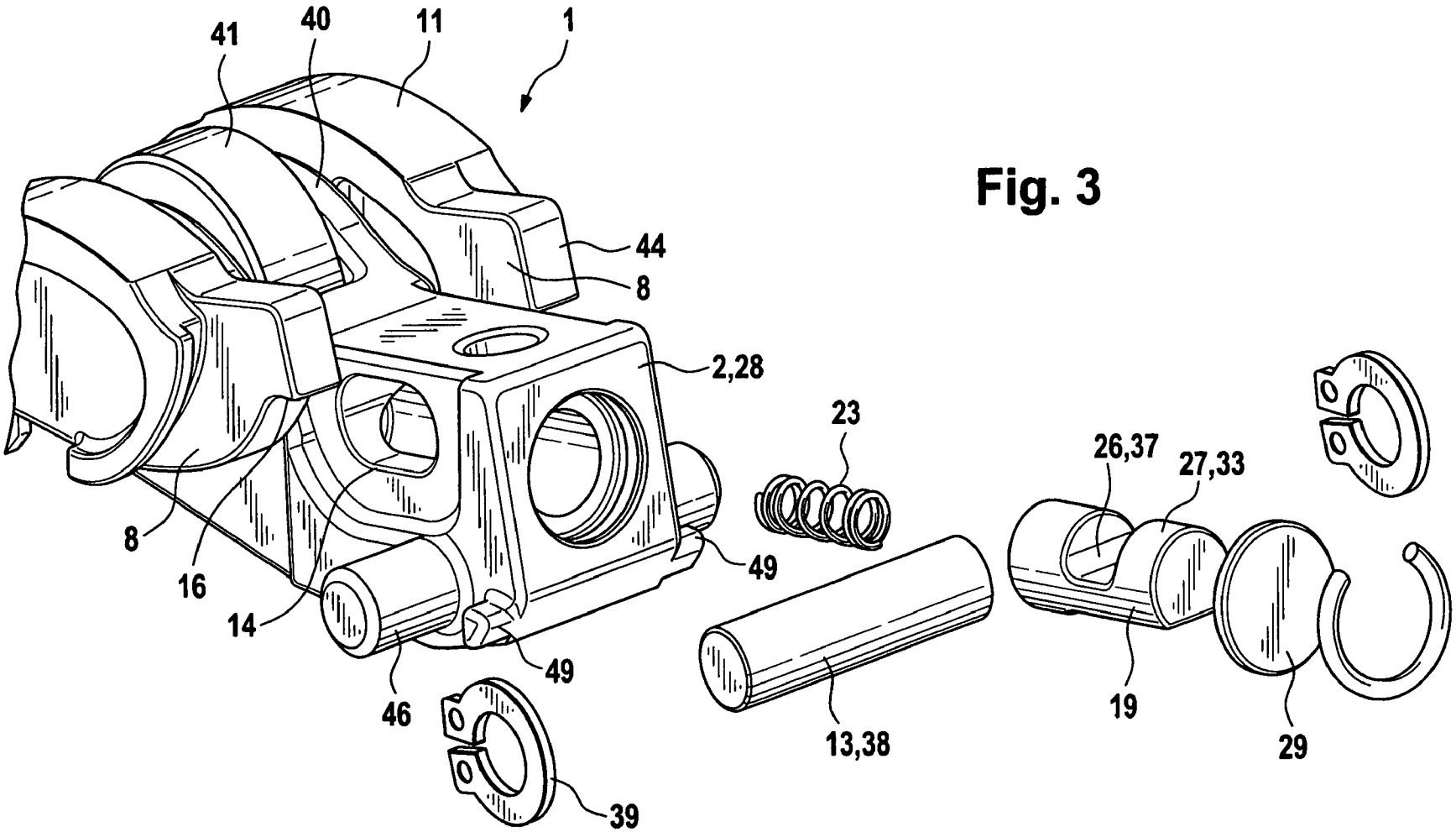
FIG. 3 shows the finger lever with its main components, in an exploded representation, likewise seen from the another end.

An upper side 33 of the entraining piston 19 (s. also FIG. 3) comprises a crosswise extending incision 26 in which is seated, while being supported on side walls 37 of the incision 26, the coupling slide 13. The coupling slide 13 protrudes (s. FIG. 1) beyond outer walls 9 of the inner lever 2 and is longitudinally displaceable in the oblong hole 14. An axial fixing of the coupling slide 13 is realized through retaining elements 39 which, as illustrated, are configured as snap rings with frictional locking, so that annular grooves in the coupling slide 13 can be dispensed with.

Directly next to the contact surface 7 on the another end 6 are arranged two further protruding axle stubs 46. A restoring spring 17 configured as a torsion leg spring extends with its coil assembly 45 on each axle stub 46. A first leg 47 of the restoring spring 17 bears against a stop 49 of the inner lever 2. A second leg 48 extends towards the one end 4 and loads a support 50 on an underside of the corresponding outer arm 8. Flanks of the second legs 48 in mesh [contact region 51] with the support 50 of the respective outer arm 8 correspond at least partially to an involute toothing of gearwheel teeth in mesh with each other, so that relatively low friction can be expected in this region.

To obtain the coupled state of the coupling device 12 shown in FIGS. 1, 2, the pressure chamber 21 is pressurized during the cam base circle phase by hydraulic medium out of the contact surface 7 supplied via the longitudinal channel 36. The entraining piston 19 is displaced against the force of its compression spring 23 towards the one end 4. During this displacement, the entraining piston 19 entrains the coupling slide 13 with which it is connected. When the coupling slide 13 has reached its final position, it engages through its end portions 15 with slight coupling lash under the entraining surfaces 16 of the outer arms 8. The finger lever 1 follows the lift of the high lift cams.

If only a low valve lift is desired on the gas exchange valve, the hydraulic medium pressure in the pressure chamber 21 is drastically reduced during the cam base circle phase, so that the entraining piston 19 together with its coupling slide 13 is displaced towards the another end 6 through the force of the compression spring 23. During this displacement, the end portions 15 of the coupling slide 13 come out of contact from the outer arms 8. During the subsequent cam lift, the outer arms 8 pivot "in idle" relative to the inner lever 2, so that the inner lever 2 executes a pivoting movement in accordance with its activating low lift cam.

The invention claimed is:

1. A switchable finger lever (1) for a valve train of an internal combustion engine, said finger lever (1) comprising an inner lever (2) comprising an underside (3) on one end (4), a support (5) for a gas exchange valve and on another end (6), a contact surface (7) for a head of a support element, said inner lever (2) comprising on the one end (4), outer arms (8) which are pivotable relative to the inner lever (2), which outer arms (8) extend in direction of the another end (6) while flanking outer walls (9) of the inner lever (2) and comprise on upper sides (10), contacting surfaces (11) for high lift cams, a coupling device (12) comprising a coupling slide (13) for simultaneously connecting the outer arms (8) to the inner lever (2) being seated in a section of the another end (6) in the inner lever (2), wherein the coupling slide (13) is seated in an oblong hole (14) extending transversely through the inner lever (2) as also in longitudinal direction of the finger lever (2), the coupling slide (13) comprises two end portions (15) which protrude beyond the outer walls (9), and for effecting coupling [high valve lift], the coupling slide (13) can be displaced with the two end portions (15) towards the one end (4) partially in or under entraining surfaces (16) of the outer arms (8) ending therein, whereas for effecting uncoupling, the coupling slide (13) can be displaced out of the entraining surfaces (16) towards the another end (6), and wherein at least one restoring spring (17) extends in a region of the another end (6) between the inner lever (2) and the outer arms (8).

2. The switchable finger lever of claim 1, wherein the inner lever (2) comprises in a region above the contact surface (7), a longitudinal bore (18) comprising an entraining piston (19), which entraining piston (19), defines with one front end (20), a pressure chamber (21) for hydraulic medium that can be supplied out of the contact surface (7) for displacing the entraining piston (19) in one longitudinal direction [coupling or uncoupling direction] while at least one compression spring (23) acts against another front end (22) of the entraining piston (19), and a further end of the compression spring (23) acts against a support (24) on a corresponding end region (25) of the longitudinal bore (18), and wherein the entraining piston (19) comprises on an outer periphery (27), one of a crosswise extending incision (26) or a crosswise extending bore in which incision (26)/bore the coupling slide (13) is seated.

3. The switchable finger lever of claim 2, wherein the longitudinal bore (18) starts from a front end surface (28) of the inner lever (2) on the another end (6) and is closed in this region by a closing element such as a plug (29), the pressure chamber (21) for the hydraulic medium being formed between this plug (29) and the facing one front end (20) of the entraining piston (19), wherein the at least one compression spring (23) acts on one side against the another, inner front end (22) or against a bottom (29*a*) of a pocket recess (30) of the inner front end (22) of the entraining piston (19) and, on another side, against a bottom (31) of the longitudinal bore (18) or against a corresponding inner stop of the longitudinal bore (18), said bottom (31)/said inner stop comprising a ventilating aperture (32) opening directly into the outside.

4. The switchable finger lever of claim 2, wherein the incision (26) on the entraining piston (19) for the coupling slide (13) is arranged on an upper side (33) of the entraining piston (19) and the oblong hole (14) is arranged on an upper side (34) of the longitudinal bore (18) to intersect the longitudinal bore (18), and wherein, when the entraining piston (19) has reached its retracted coupling position, the one, outer front end (20) of the entraining piston (19) does not intersect an outer end (35) of the oblong hole (14).

5. The switchable finger lever of claim 2, wherein the contact surface (7) for the support element is configured as a semi-spherical cavity on the underside (3) of the inner lever (2), from which contact surface (7) either a) a branch bore leads directly into the pressure chamber (21) behind the one, outer front end (20) of the entraining piston (19), or b) the entraining piston (19) or the longitudinal bore (18) or both comprise a longitudinal channel (36) which at least indirectly intersects the contact surface (7) and opens into the pressure chamber (21).

6. The switchable finger lever of claim 2, wherein the coupling slide (13) in the incision (26) of the entraining piston (19) is guided solely by side walls (37) of the incision (26).

7. The switchable finger lever of claim 2, wherein an axial fixing of the coupling slide (13) is realized through two retaining elements (39) such as frictionally locking snap rings or shaft snap rings [in annular groove] which extend on an outer periphery (38) of the coupling slide (13) and directly adjoin the outer walls (9) of the inner lever (2).

8. The switchable finger lever of claim 2, wherein, starting from the another end (6) of the inner lever (2) comprising the longitudinal bore (18), the inner lever (2) branches in direction of the one end (4), at least in a central region, into two spaced apart arms (40) between which a rolling bearing-mounted or slide bearing-mounted roller (41)/disk is received as a running surface for a low lift cam [valve lift alteration] or for a zero lift cam [valve deactivation].

9. A method of assembling the coupling device (12) and adjusting a coupling lash in a finger lever (1) of claim 2, comprising following steps:

a) Insertion of the at least one compression spring (23) into the longitudinal bore (18);

b) Installation of the entraining piston (19) in the longitudinal bore (18);

c) Insertion of a constant diameter calibrating coupling slide into the incision (26)/the bore of the entraining piston (19) and displacement of the entraining piston (19) into coupling position;

d) Loading, in a cam-opposed direction, the outer arms (8) which bear against an inner or an outer stop acting in cam direction, till the outer arms (8) come to be seated with entraining surfaces of the center arms (8) (16) configured as flats or cylindrically shaped portions, on end portions of the calibrating coupling slide, and measurement of this idle displacement;

e) Removal of the calibrating coupling slide, calculation of a required thickness of a coupling slide and appropriate pairing and installation of a variable thickness off-the-shelf coupling slide (13), so that a defined minimum coupling lash is obtained;

f) Axial securing of the coupling slide (13) and closing of the longitudinal bore (18).

10. The switchable finger lever of claim 1, wherein the contacting surfaces (11) of the outer arms (8) are cylindrically arched sliding surfaces and project after the manner of wings away from the outer arms (8).

11. The switchable finger lever of claim 1, wherein an axle stub (42) projects integrally from each of the outer walls (9) of the inner lever (2) on the one end (4), or end portions of a continuous axle project outwards, on which axle stubs (42) or end portions, the outer arms (8) are seated for rotation.

12. The switchable finger lever of claim 11, wherein the outer arms (8) seated on the axle stubs (42)/end portions comprise an axial anti-loss device (43) in form of a securing element such as either a snap ring/a snap washer with friction locking or a shaft snap ring/a shaft snap washer or a bent shaft snap ring/a bent shaft snap washer.

13. The switchable finger lever of claim 1, wherein the entraining surfaces (16) on undersides of the outer arms (8) extend directly in the region of front ends (44) of the outer arms (8) on the side of the another end (6) and are configured either as flats or as cylindrically shaped portions.

14. The switchable finger lever of claim 1, wherein two restoring springs (17) configured as torsion leg springs are arranged on the another end (6), each coil assembly (45) of each torsion leg spring is seated on an axle stub (46) which protrudes in a section of the another end (6) from the outer wall (9) of the inner lever (2), and wherein a first and a second leg (47, 48) extends away from each coil assembly (45), said first leg (47) being biased against a stop (49) of the inner lever (2) and said second leg (48) being biased against a support (50) of an underside of a respective one of the outer arms (8).

15. The switchable finger lever of claim 14, wherein flanks of the second legs (48) in mesh [contact region (51)] with the support (50) of the respective outer arm (8) correspond at least partially to an involute toothing of gearwheel teeth in mesh with each other.

16. The switchable finger lever of claim 1, wherein the outer arms (8) are made as separate pieces from each other.

* * * * *